US008851289B2

(12) United States Patent
Shi

(10) Patent No.: US 8,851,289 B2
(45) Date of Patent: Oct. 7, 2014

(54) VACUUM PACKING BAG

(76) Inventor: Zhengbing Shi, Guangdong (CN)

( * ) Notice: Subject to any disclaimer, the term of this patent is extended or adjusted under 35 U.S.C. 154(b) by 289 days.

(21) Appl. No.: 13/394,811

(22) PCT Filed: Jan. 11, 2010

(86) PCT No.: PCT/CN2010/070111

§ 371 (c)(1),
(2), (4) Date: Mar. 8, 2012

(87) PCT Pub. No.: WO2011/029287

PCT Pub. Date: Mar. 17, 2011

(65) Prior Publication Data

US 2012/0181210 A1 Jul. 19, 2012

(30) Foreign Application Priority Data

Sep. 10, 2009 (CN) ..... 2009 2 0194800 U
Sep. 10, 2009 (CN) ..... 2009 2 0194816 U

(51) Int. Cl.

| | |
|---|---|
| ***B65D 81/20*** | (2006.01) |
| ***B65D 77/04*** | (2006.01) |
| ***B65D 25/10*** | (2006.01) |
| ***B65D 33/01*** | (2006.01) |
| ***B65D 77/06*** | (2006.01) |
| ***B65D 33/25*** | (2006.01) |
| ***B65D 5/64*** | (2006.01) |

(52) U.S. Cl.

CPC ..... *B65D 33/01* (2013.01); *B65D 77/04* (2013.01); *B65D 25/102* (2013.01); *B65D 77/062* (2013.01); *B65D 33/2508* (2013.01); *B65D 5/643* (2013.01)

USPC ..... 206/524.8; 206/478; 220/495.06; 383/103

(58) Field of Classification Search

CPC .... A45C 13/03; B65D 81/2038; B65D 77/06; B65D 85/16

USPC ..... 206/223, 522, 524.8, 812, 460, 206/477–483; 383/3, 63, 100, 103; 220/495.01, 495.05, 495.06; 150/106, 150/107

See application file for complete search history.

(56) References Cited

U.S. PATENT DOCUMENTS

| | | | | |
|---|---|---|---|---|
| 1,607,602 | A * | 11/1926 | Bindseil | 206/353 |
| 2,425,035 | A * | 8/1947 | Garnett et al. | 383/18 |
| 6,202,849 | B1 * | 3/2001 | Graham | 206/524.8 |
| 6,499,574 | B1 * | 12/2002 | Anthony | 206/524.8 |
| 7,674,041 | B2 * | 3/2010 | Frayne | 206/524.8 |
| 2005/0152801 | A1 * | 7/2005 | Chen | 417/572 |
| 2005/0155891 | A1 * | 7/2005 | Chen | 206/524.8 |
| 2005/0173439 | A1 * | 8/2005 | Chen | 220/495.06 |
| 2009/0080809 | A1 * | 3/2009 | Pham et al. | 206/524.8 |

* cited by examiner

*Primary Examiner* — Luan K Bui

(74) *Attorney, Agent, or Firm* — George G. Wang; Bei & Ocean

(57) ABSTRACT

This invention provides a vacuum bag, including vacuum bag (1), gas nozzle (13) on the bag (1) which can exhaust air out, inlet (11) in the upper part of vacuum bag through which items can be placed into the bag, and sealing device (12) which can seal the inlet. The invention is characterized in its outer packing part (2) which can incorporate up the bag, and tightening device (3) between the vacuum bag and outer packing part. This invention overcomes the shortage of current craft and provides a vacuum bag with reasonable structure, that is easy to use and can be stacked neatly and prevents from damage.

13 Claims, 11 Drawing Sheets

VACUUM PACKING BAG

FIELD OF THE INVENTION

This invention refers to a packing bag, especially refers to a vacuum packing bag to store clothes and other daily used stuff.

BACKGROUND OF THE INVENTION

In our daily life, the vacuum bag is used to store stuffs such as clothes and bed quilt, and its humidity-proof and dust-proof features provides many conveniences for people's life.

The existing vacuum bag is generally made of soft bag body with the materials such as PVC or nylon composite film, and then adding a seal strip at the bag's mouth and a nozzle on the bag body. With the improvement of living standard, people have much higher requirement on the vacuum bag. However, because it is soft, the shape can not be irregular after clothes or bed quilt are put and it is difficult to stack it nicely in wardrobe or other storing spaces, besides, it could easily be scratched and damaged by sharp and hard object, and the life time is shortened therefore.

SUMMARY OF THE INVENTION

This invention overcomes the shortcomings in existing technology and provides a vacuum bag with reasonable structure, easy to use, in which the things may be stacked nicely and prevent from being damaged.

In order to solve the existing technical problem, this invention adopts the following technical solutions.

The above-mentioned vacuum packing bag, including a vacuum bag on which there is a gas nozzle to exhaust air out, an opening in the upper part of the bag through which items can be put into the bag and a sealing device that can seal the opening, is characterized by the design that it has an outer packing unit to fold the vacuum bag with at least a buckle device between the bottom of the vacuum bag and the outer packing unit.

The above-mentioned vacuum packing bag is characterized by the design that it has the buckle device including a buckled belt to fasten the button hole at the button of the vacuum bag and the button hole on the outer packing unit.

The above-mentioned vacuum packing bag is characterized by the design that there are more than two sheet-body connecting edges on the bottom of the vacuum bag to form the vacuum bag, and the button hold is on the connecting edge.

The above-mentioned outer packing device in this invention may be a case body or a packing bag, whose outer packing unit may have a cover or not.

The above-mentioned vacuum packing bag is characterized by the design that the outer packing unit is a rectangular case body and the button belt locates on the base board of the case body, and the outer packing unit has a cover, that is to say, there is a cover board in the upper part of the case body to seal the opening in the case body.

The above-mentioned vacuum packing bag is characterized by the design that the case body has a rectangular hard base board, to which 4 hard side boards are respectively connected at the 4 edges of 4 paper boards, and the side boards may fold upward to form the side wall of the case body and the overlapping of the edges with side boards next to it form the case body by velcro.

The above-mentioned vacuum packing bag is characterized by the design that the outer packing unit is made of soft material, and in order to make the packing bag as outer packing unit to have a relatively regular shape and the bottom to have a good support to the vacuum bag, a supporting board may be added on the bottom of the vacuum bag, then it may be put into the packing bag together with the vacuum bag. The soft material can be cloth, leather, or soft composite material etc.

The above-mentioned vacuum packing bag is characterized by the design that it has the folding mark on both ends of the supporting board to make them as the bottom board, and left side and right side boards that may fold upward. The above-mentioned vacuum bag sits on the bottom of supporting board, and the left and right side boards may be folded and then be put into the cloth bag together with vacuum bag. Therefore, the hard supporting boards are used to keep the packing bag in a regular shape on one hand, and the vacuum bag can be protected by the hard supporting board on anther hand.

This invention can further make opposite folding marks between the bottom boards of the supporting board so to get a smaller size for storage.

The above-mentioned vacuum packing bag is characterized by the design that the vacuum bag has a flat bottom, the two edges of this flat bottom and the two facades of the vacuum bag create two opposite edges, and there are 4 button holes, of which 2 button holes are made on one connecting edge, and the other 2 button holes are made on the other connecting edge, used to connect with the button belt on the bottom board of outer packing unit or the button belt on the supporting board.

The above mentioned vacuum packing bag is characterized by the design that its bottom is a sharp bottom formed by connection of the two parts of the vacuum bag body, and the sharp bottom forms a connecting edge. The above-mentioned 2 button holes locate respectively on the connecting edge and the button belt locates on the bottom board of outer packing unit. There are two button belts to connect with the button holes respectively for connection of the vacuum bottom and the outer packing unit.

The above-mentioned vacuum packing bag is characterized by the design that there is packing belt, and one end of it (free end) connects with an elastic chuck, and there is also a packing belt on the cover of outer packing unit in order to insert the said button hole for fixing the connection between the outer packing unit and the cover.

The above-mentioned vacuum packing bag is characterized by the design that a handle is placed on the outer packing unit for the convenience of handling. For example, a handle is installed on the front side board of the case body or on the surface of the front side face of the packing bag; of course, the handle can also be placed on the cover board of the case body or on the upper surface of the packing bag.

Compared with the existing technology, this invention has the following advantages: Firstly, this invention enables the vacuum bag to put into the outer packing unit, for example, after the case body or the packing bag is packed, it makes a removable connection between vacuum bag and outer packing unit; when storing clothes and bed quilt, it can maintain the vacuum bag in a regular shape like a square after compression by making use of the regular outer shape of the outer packing unit, so the things can be stacked easily and nicely in the wardrobe. Furthermore, since the vacuum bag is placed in the outer packing unit, it will have a better protection for the vacuum bag and prevent it from being scratched to have a longer life. Secondly, a handle is placed on the outer packing unit, which is convenient for carrying and handling.

Thirdly, when the bag is not in use, this invention may, by using the buckle unit, be disassembled easily and occupy less space after folding.

Fourthly, the connection between the vacuum bag and the outer packing unit is realized through the buckle unit, both connection and disconnection are very convenient, they may even be used separately after disconnection, so it is very convenient for use.

DETAILED DESCRIPTION OF PARTICULAR EMBODIMENTS OF THE INVENTION

Figure 1:
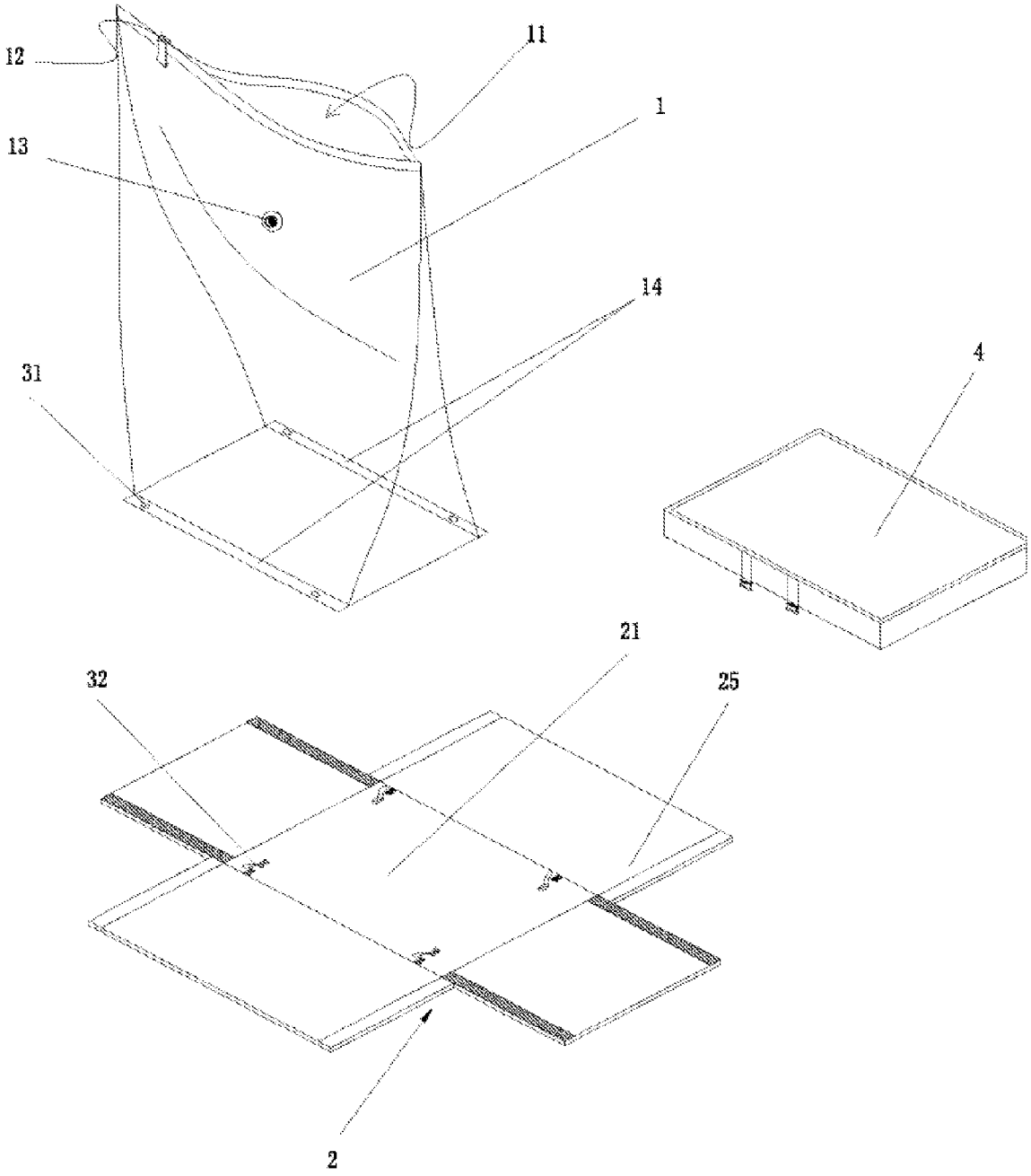
FIG. 1 is the decomposition diagram of application example 1 of this invention.
Figure 2:
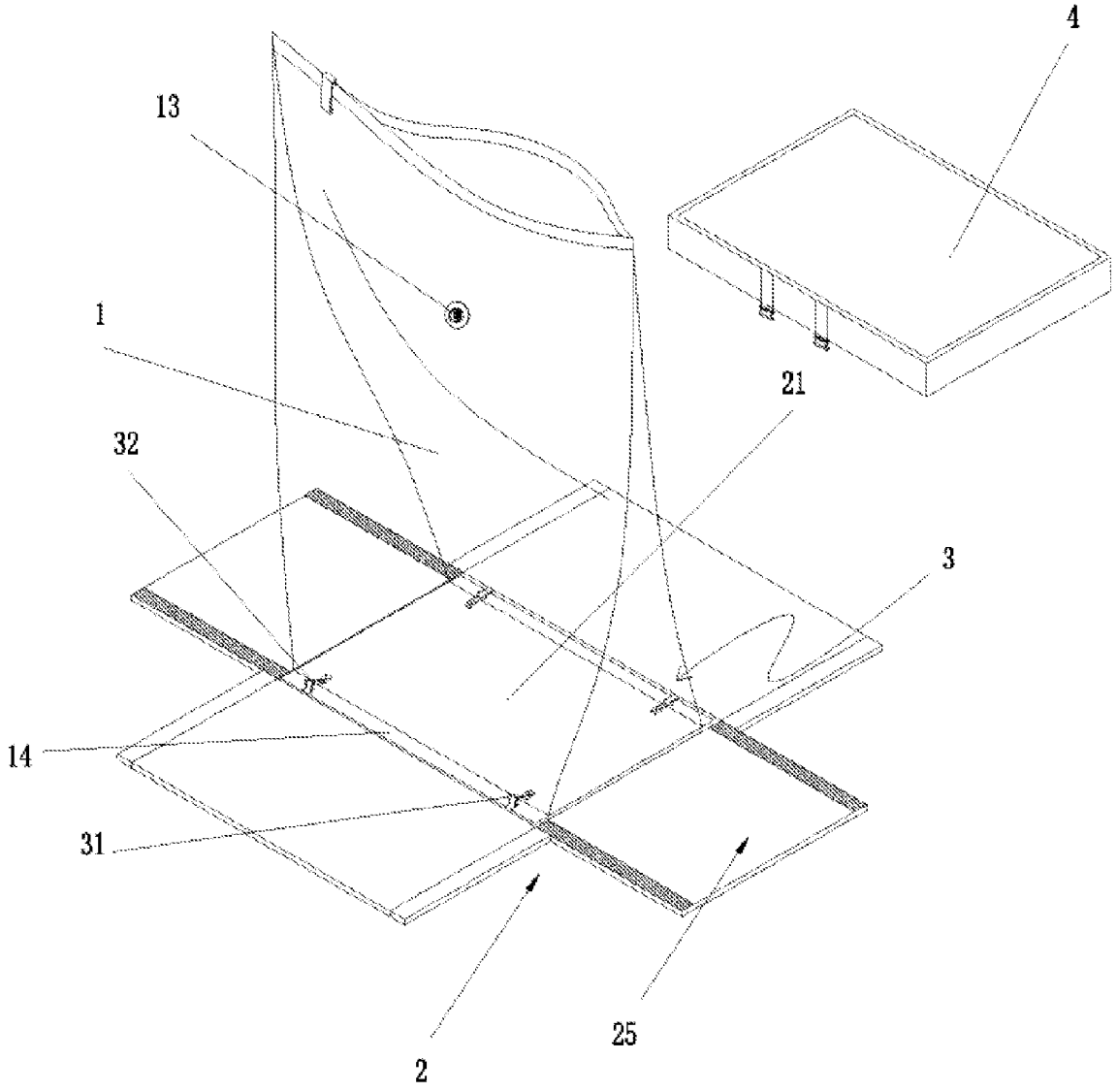
FIG. 2 is the partial decomposition diagram of the vacuum bag and the bottom board of the case body as application example 1 of this invention.
Figure 3:
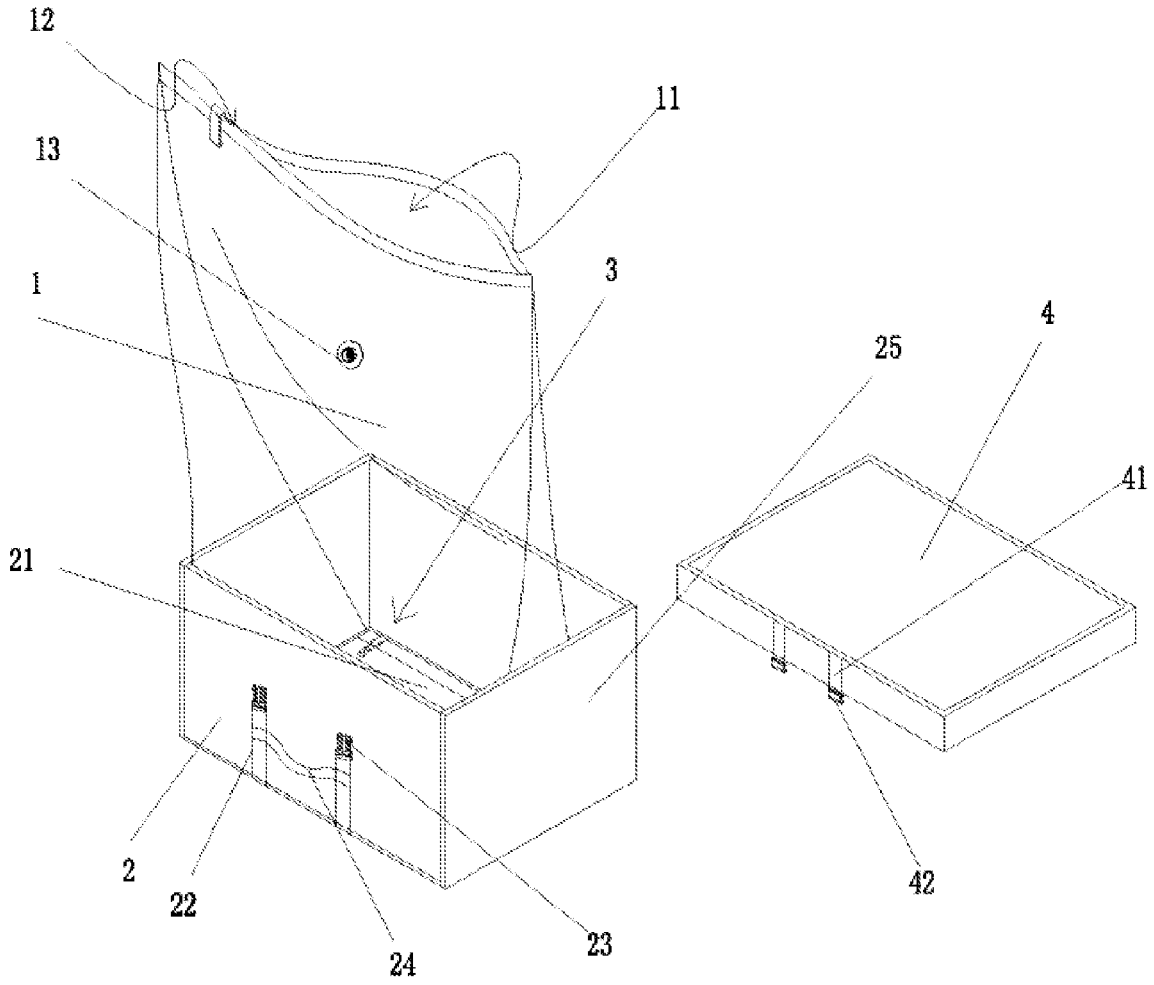
FIG. 3 the 3D diagram of connecting the vacuum bag bottom to the case body bottom as application example 1 of this invention.
Figure 4:
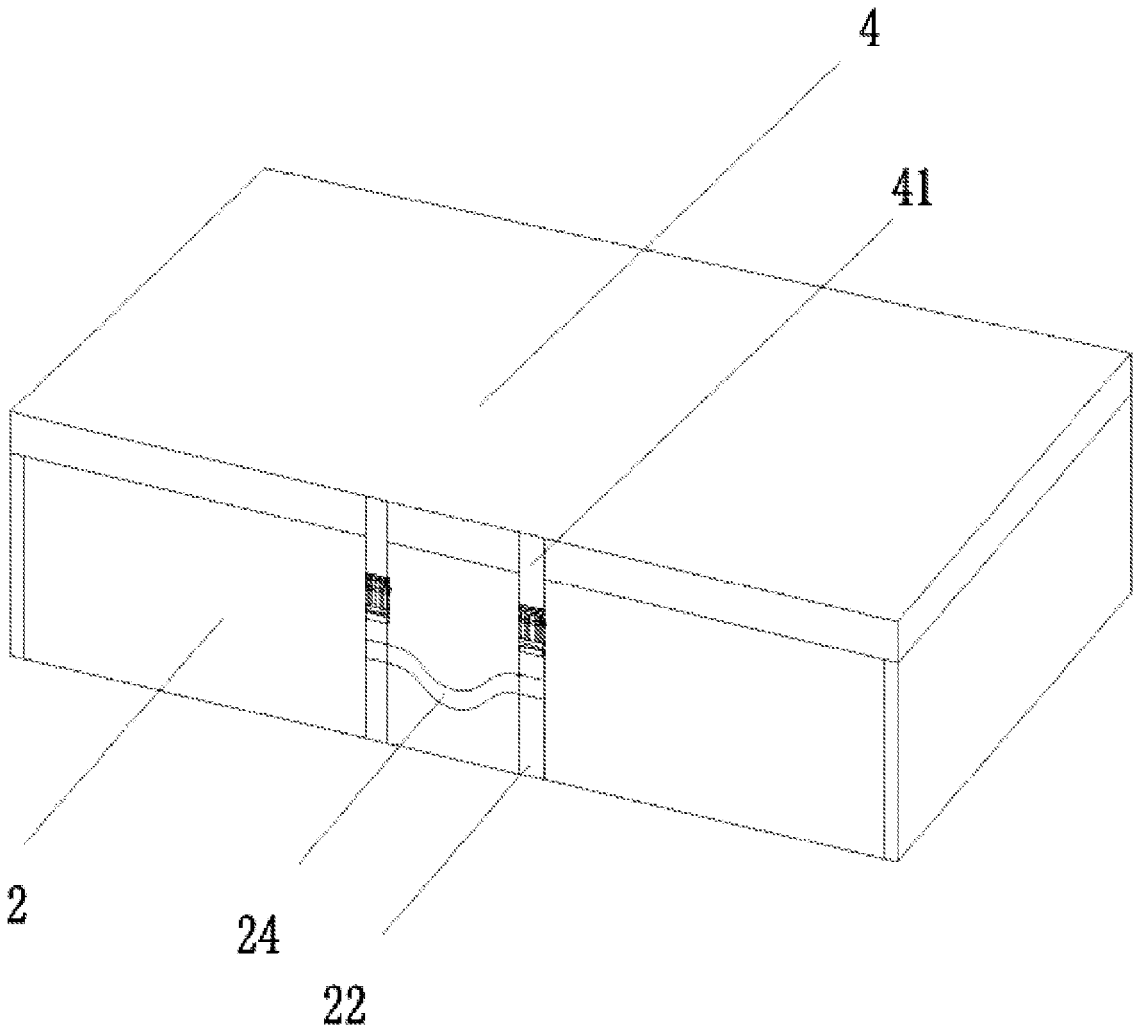
FIG. 4 the 3D diagram of the upper cover panel stored in the case body cover of the vacuum bag as application example 1 of this invention.
Figure 5:
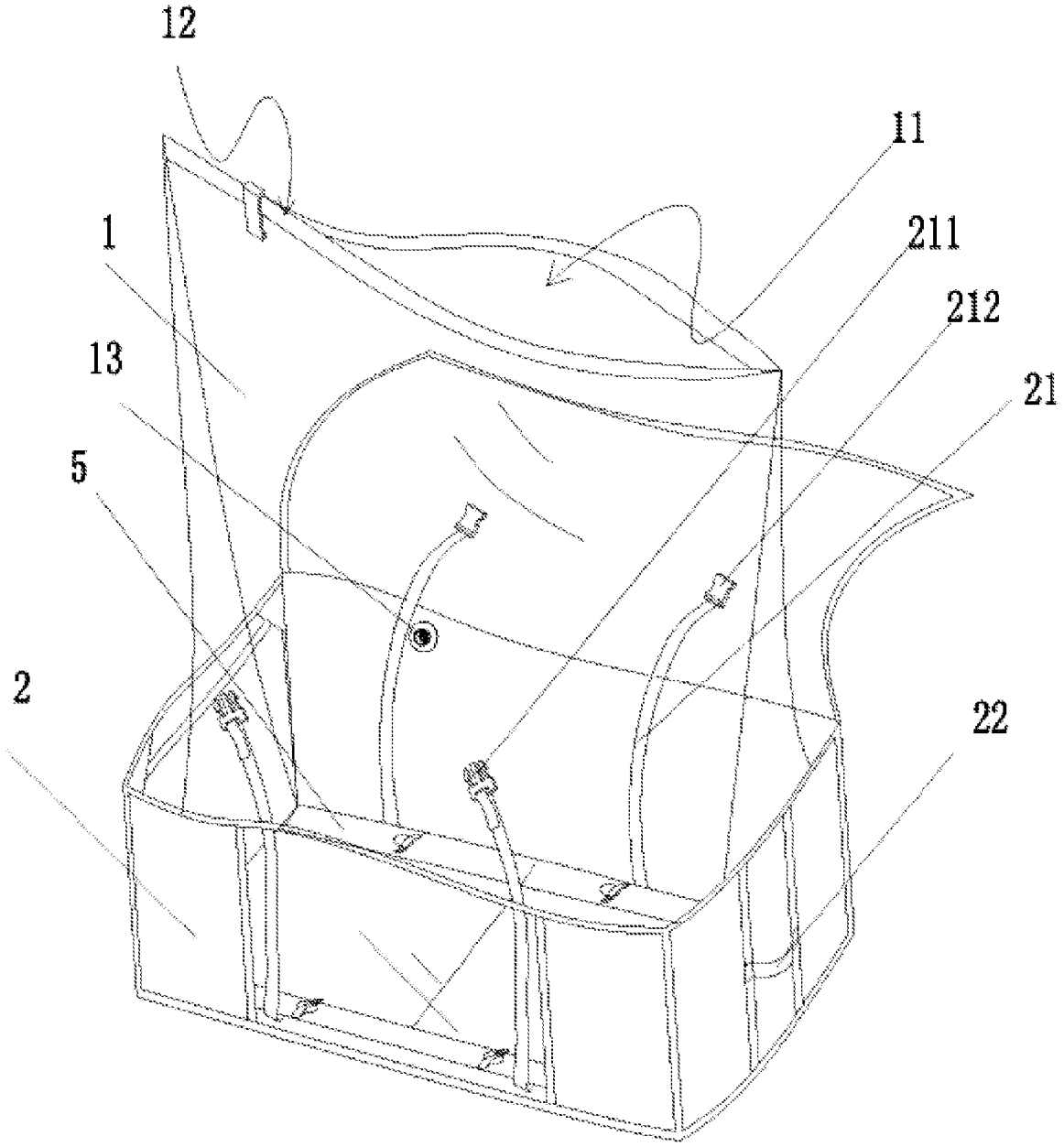
FIG. 5 is the 3D diagram as application example 2 of this invention.
Figure 6:
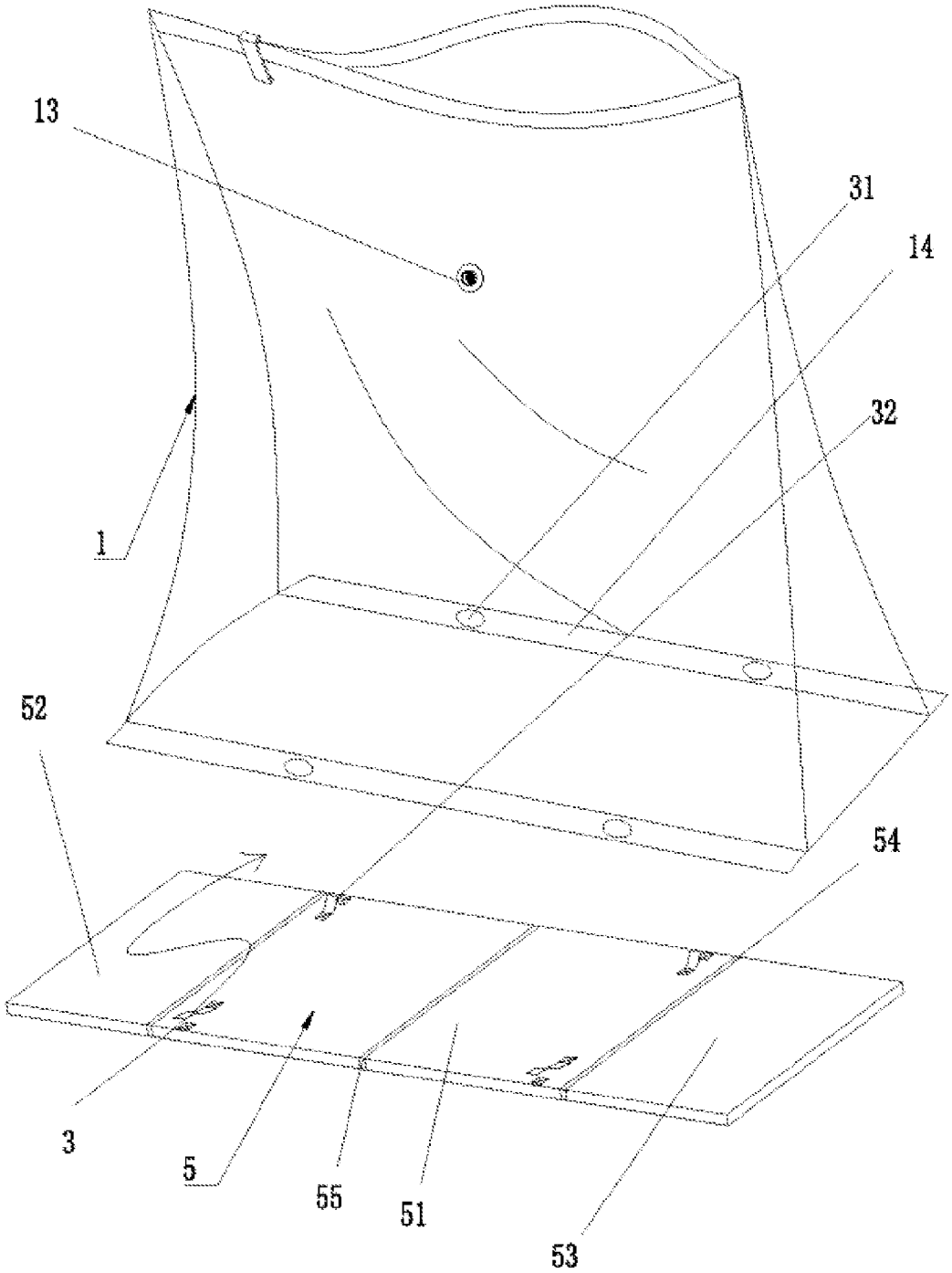
FIG. 6 is the decomposition diagram of cloth bag removal as application example 2 of this invention.
Figure 7:
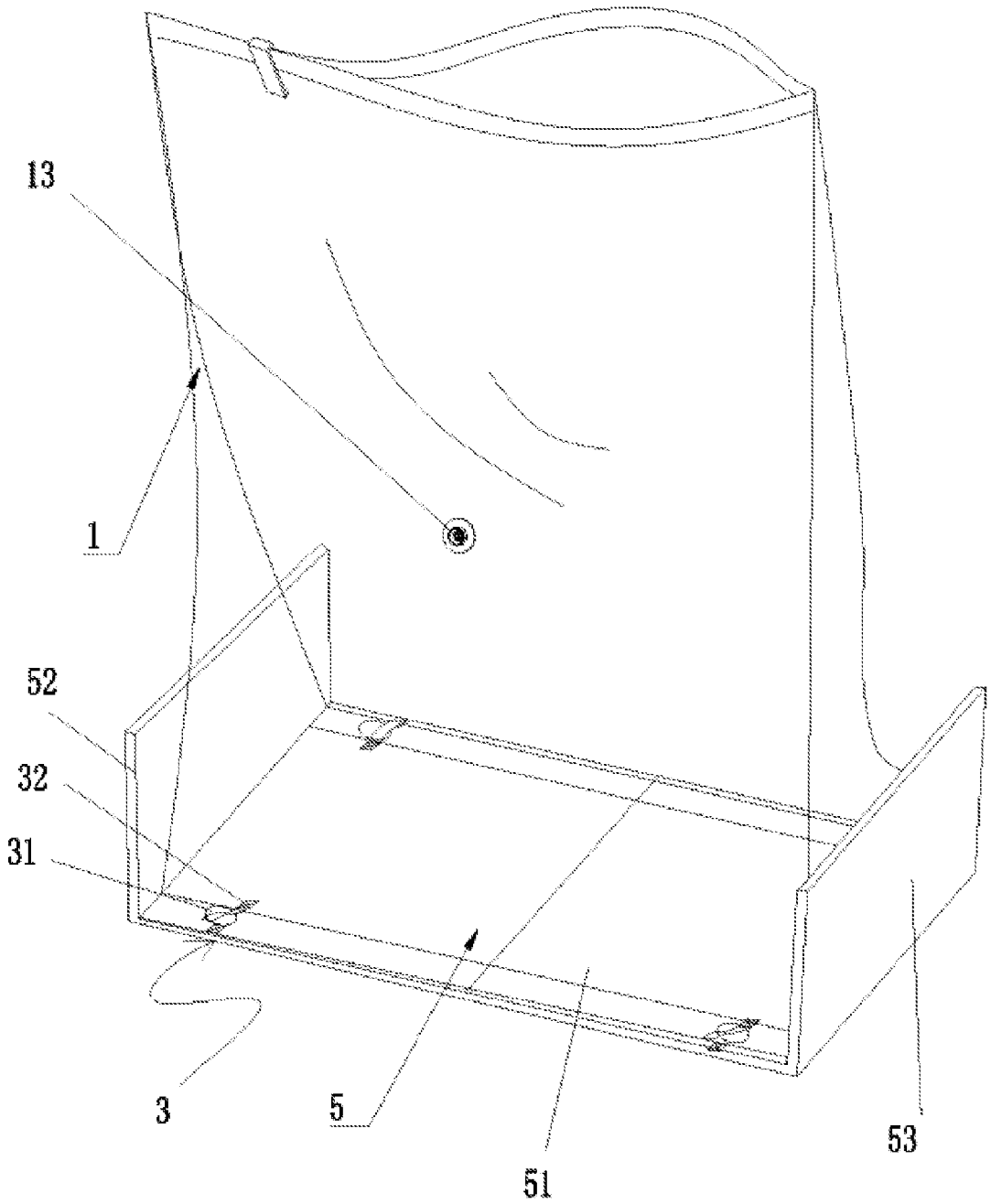
FIG. 7 is the 3D diagram of cloth bag removal as application example 2 of this invention.
Figure 8:
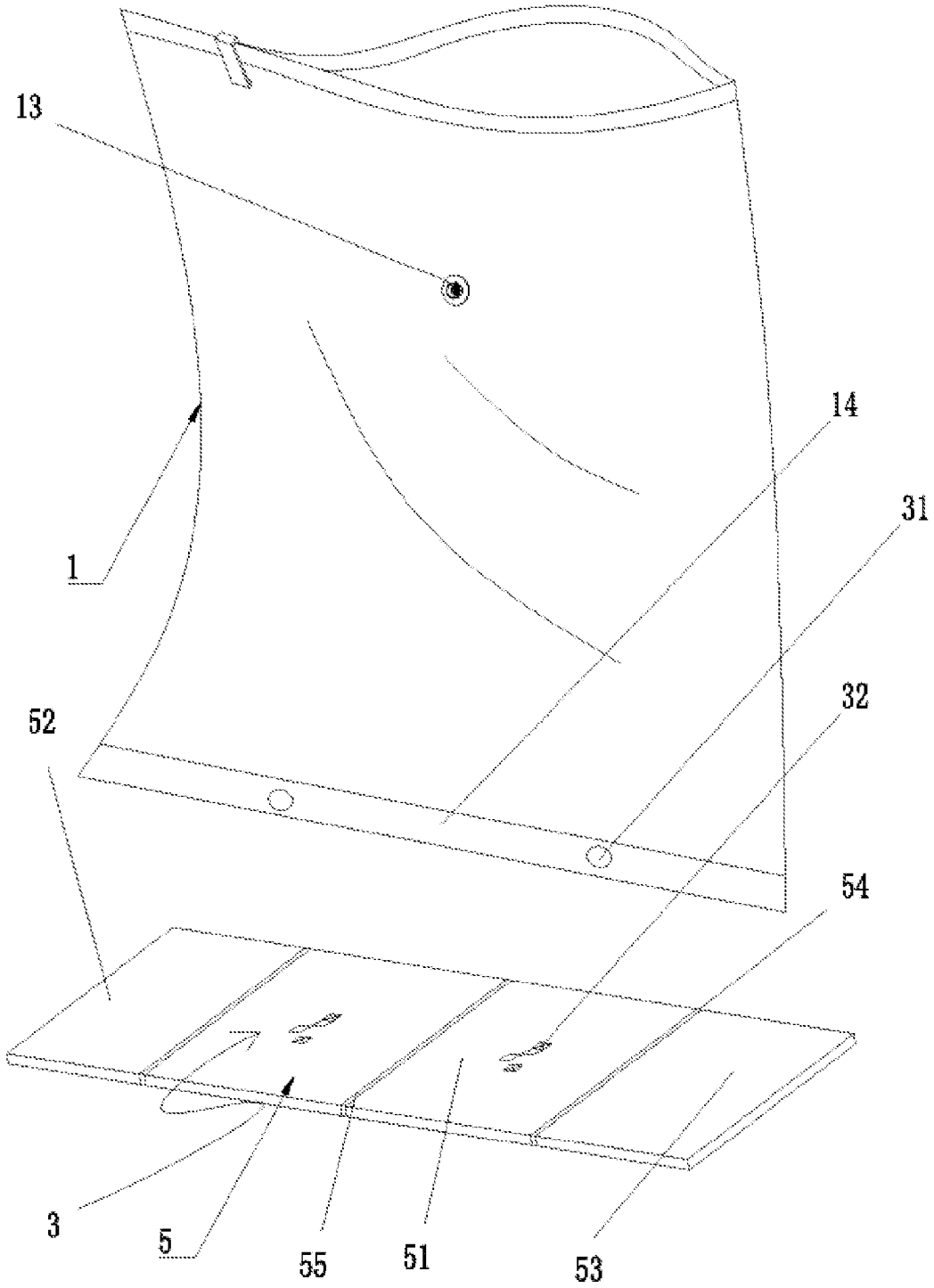
FIG. 8 is the decomposition diagram of cloth bag removal as application example 3 of this invention.
Figure 9:
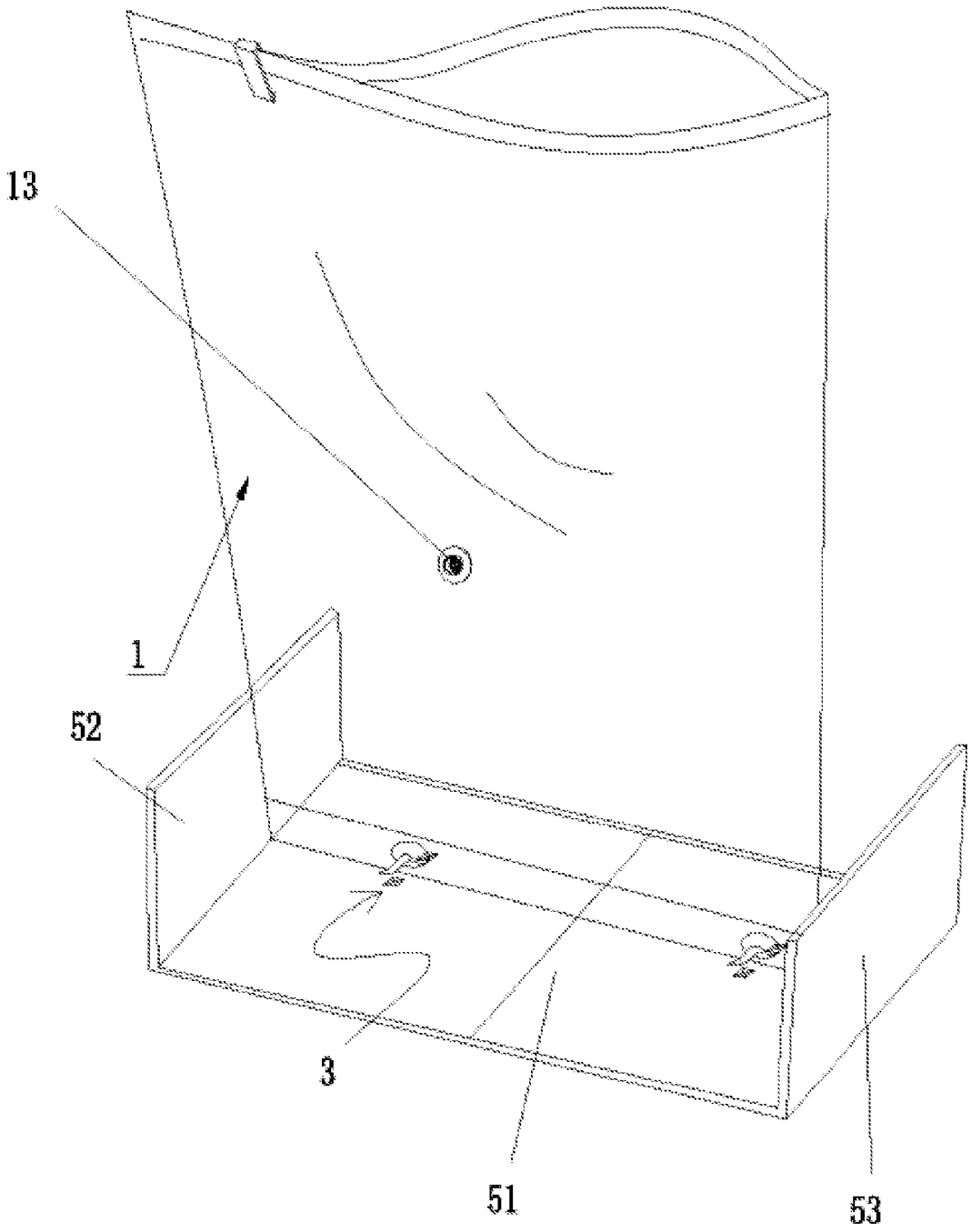
FIG. 9 is the 3D diagram of cloth bag removal as application example 3 of this invention.
Figure 10:
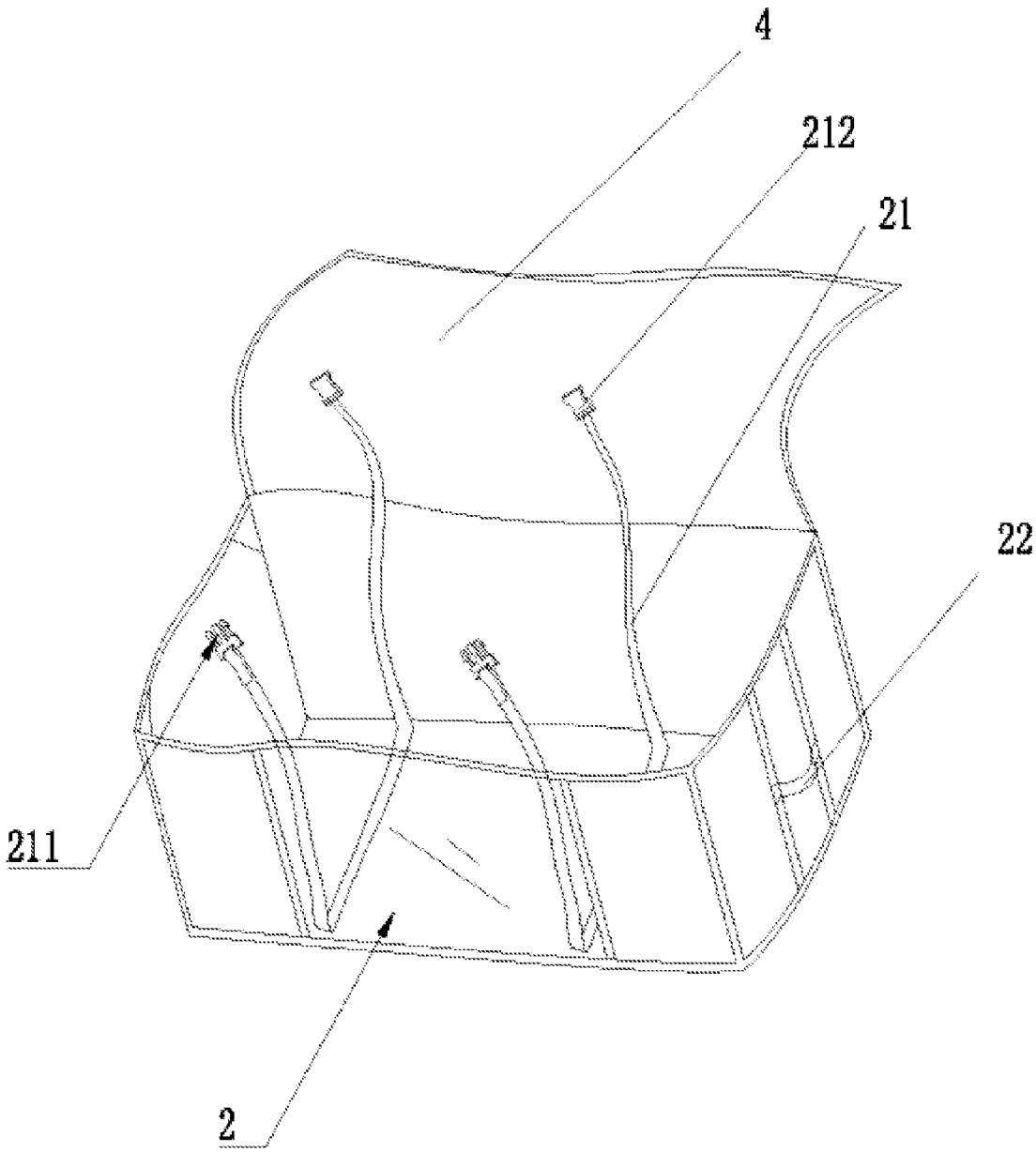
FIG. 10 is the 3D diagram of cloth bag as application example 3 of this invention.

The following is the detailed description of this invention together with the figures:

As shown in FIG. 1-4 of application example 1 of this invention, this is a kind of vacuum packing bag including vacuum bag (1) made of plastic and the outer packing unit (2) placed on the bottom of the plastic vacuum bag (1) that can store the plastic vacuum bag (1), and the above-mentioned outer packing unit (2) is a cubic case body with cover panel (4).

There is a nozzle (13) on the plastic vacuum bag (1) to exhaust air in the vacuum from the nozzle (13) after loading the clothes and other objects. On the upper part of the case body, there is a cover panel (4) to cover the case body (2), and there is a buckle device (3) between the plastic vacuum bag (1) and the case body (2), which is made for connecting the plastic vacuum bag (1) and the case body (2). The above-mentioned buckle device includes button hole (31) in the bottom of the plastic vacuum bag (1) and button belt (32) to fasten the button hole (31) on the case body (2). One end of this button belt (32) is fixed on the paper bottom board (21) of the case body (2) and the other end goes through the button hole to connect the paper bottom board (21) by use of the buttons, or it may also connect with the paper bottom board (21) by Velcro, which is more convenient. The above-mentioned plastic vacuum bag has a rectangular flat bottom at its bottom. The two edges of this flat bottom and the two vertical surfaces of the vacuum bag together form 2 connecting edges (14) in opposition, and the connecting edges (14) do not connect with the space inside the plastic vacuum bag, and the above-mentioned button hole (31) locates on the connecting edges (14). In this way, both the installation and the disassembly of the case body (2) and plastic vacuum bag (1) are very convenient, and after the plastic vacuum bag (1) has been dissembled apart from the case body (2), they may be used separately, very convenient for use.

The above-mentioned case body (2) has a rectangular 4-side paper bottom board (21), and the 4 sides of the paper board (21) are respectively connected to the 4 edges of the side board (25) made of paper, and the paper side board (25) next to them is connected by velcro. There are 2 connecting edges (14) at the bottom of vacuum bag, respectively placed on the opposite edges of the bottom of plastic vacuum bag 1), and there are 4 button holes (31), of which 2 holes (31) are placed on one connecting edge (14) and the other 2 button holes (3) are placed on the other connecting edge (14). The button belt (32) is placed on the paper bottom board (21) of the case body (2), and there are 4 button belts (32) that connect respectively to the 4 button holes (31).

There is a packing belt (22) placed on the case body (2). One end of the packing belt (free end) is connected with the elastic chuck (23), and there is also a packing belt (41) on the cover panel (4) that is available for the elastic head (23) to insert in the button hole (42), the elastic head (23) buckles the said button hole (42) so as to fix the cover panel on the case body. Besides, a handle (24) is placed on the front side of the case body (2) for user's convenience of carrying.

As shown in diagram 5-7 as application example 2 of this invention, the vacuum packing bag including the vacuum bag (1) made of plastic, the supporting board (5) placed on the bottom of the vacuum bag and the outer packing unit that is placed on the outer part of the vacuum bag and can store the plastic vacuum bag, that is, the packing bag made of non-woven cloth, which is hereafter initially called "cloth bag" (2). The said cloth bag (2) is in a cubic shape, with the seal cover (4) and a transparent window at the front vertical surface so that user may see the stored articles without opening the bag.

There is an inlet (11) on the upper part of the plastic vacuum bag through which the stuff may be put in and the seal device (12) to seal the inlet (11). User may put the objects into the bag through the inlet (11) and then seal the inlet with the seal device (12). The seal device (12) consists of one slot and one protruding strip, and the protruding strip completes the sealing by clipping into the slot. There is gas nozzle (13) in the plastic vacuum bag for air exhausting, and the air inside the bag may be exhausted through gas nozzle (13) after the clothes and other objects are put nicely.

There is a buckle device (3) between the bottom of plastic vacuum bag (1) and the supporting board (5) in order to connect the plastic vacuum bag (1) and the supporting board (5). The buckle device includes the button hole (31) on the bottom of the plastic vacuum bag (1) and the button belt (32) to clip the button hole (31) on the supporting board. One end of this button belt (32) is connected to the supporting board 95) and another end is connected to the supporting board (5) through button hole (31) by use of the button or velcro. The use of vecro will be more convenient. There is connecting edge (14) placed on the bottom of the said plastic vacuum bag (1), which doesn't connect with the space in the plastic vacuum bag (1), and the said button hole (31) is placed on the connecting edge (14).

There are folding marks (54) placed at both ends of the supporting board (5) to form the bottom board (51) and two foldable left and right side boards (52, 53). The bottom of the said plastic vacuum bag (1) is placed on the bottom (51) of the supporting board (5), and there may be folding mark (55) in the middle of the bottom board (51). After the left and right side edges of the supporting board (5) are folded up, they can be put into the cloth bag (2) together with the plastic vacuum bag (1).

The above-mentioned plastic vacuum bag (1) has a 4-side bottom and there are two conecting edges (14), placed respectively on the opposite edges at the bottom of the plastic vacuum bag (1). There are 4 button holes (31, of which two holes (31) are placed at the connecting edge (14) and another two holes (31) are placed at another edge (14). The said button belt (32) is placed at the bottom board (21), and there are four button belts (32) to chuck the button hole (31) at the bottom of the plastic vacuum bag (1) to realize the clipping.

As shown in diagram 8-10 as application example 3 of this invention, the vacuum bag (1) has a sharp bottom, one connecting edge (14) and two button holes (31) placed respectively on the connecting edge (14) of the vacuum bag (1), and the button belt (32) is placed on the bottom board (21). There are two button belts (32) that respectively connect with the two button holes (31). The button belt (32) clips the button hole (31) on the bottom of the plastic vacuum bag (1) to realize the clipping.

There is a packing belt (21) placed in the cloth bag (2). An elastic chuck head (211) is connected to the free end of the belt and a button hole (212) available for elastic chuck head (211) to insert is connected to another end of the packing belt. The elastic chuck head (211) is inserted into the button hole (212). There is also a handle (24) placed on the two side surfaces of cloth bag (2) for convenient carrying.

When the vacuum bag is dissembled for storing objects, first the plastic vacuum bag (1) together with the supporting board (5) may be taken out from the cloth bag (2), then loose the button belt (32) to separate the plastic vacuum bag (1) from the supporting board (5).

Figure 11:
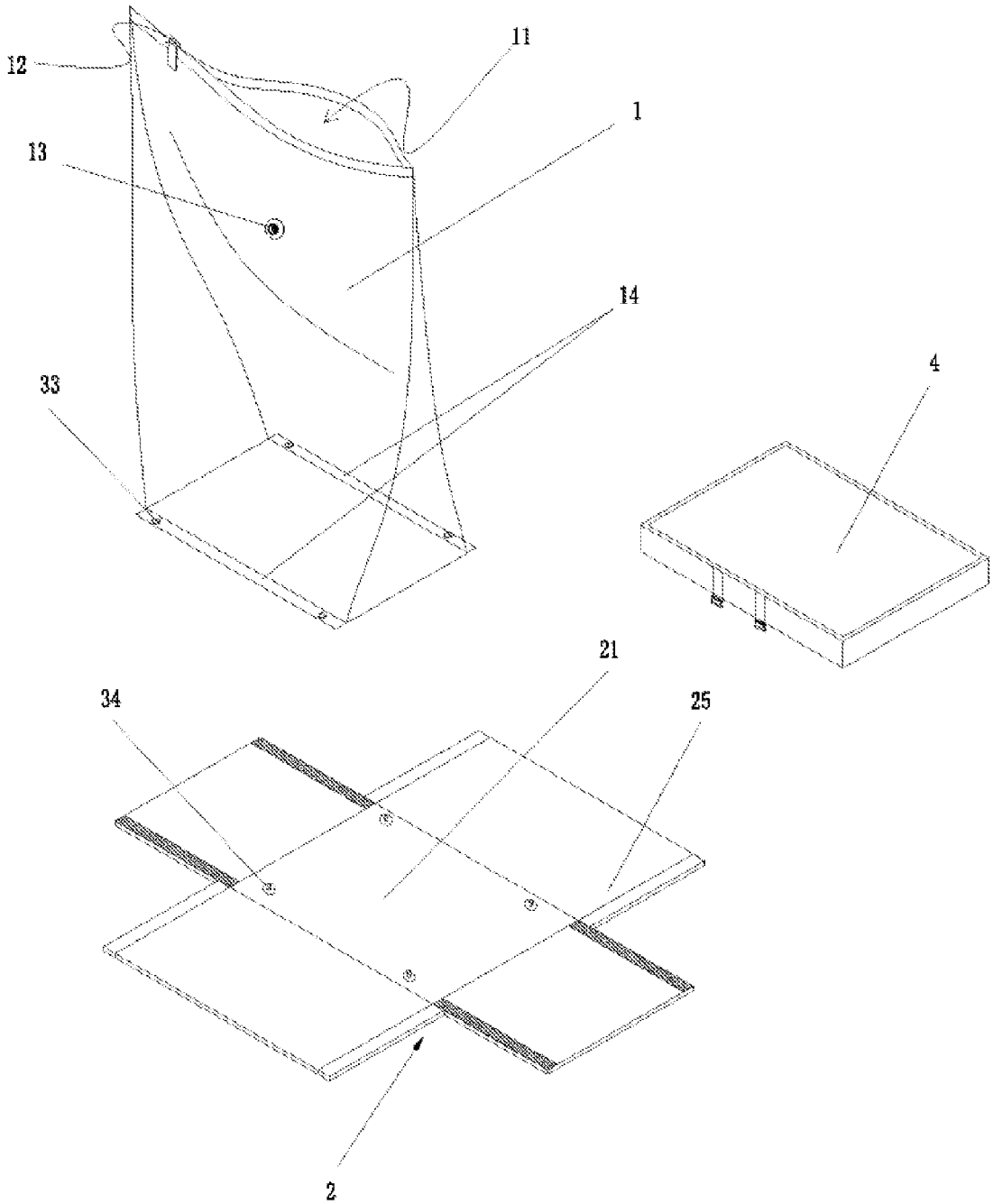
FIG. 11 is the partial decomposition diagram of cloth bag as application example 3 of this invention.

The above application examples are provided for having a good understanding of this invention and they are not the limit to this invention. Ordinary technicians in this field may, on basis of the technical solution as stated in the claim, create several kinds of changes or change its type, for example, the buckle device (3) as stated in this invention may also be placed on the press button of the vacuum bag (1) or that of the outer packing unit (3) to realize the connection, by which the connection may be realized through fastening the main button (33) placed on the connecting edge (14) at the bottom of the vacuum bag and the match button (34) placed at the bottom of the outer packing unit (3). Please refer to FIG. 11.

What is claimed is:

1. A vacuum packing device, comprising a vacuum bag, a gas nozzle on said bag for vacuuming said bag, an opening at upper end of said bag for placing stuff into said bag, a sealing element for sealing said opening, an outer packing unit for storing said bag in a folded state, and at least one fastening element for connecting said bag to said outer packing unit, said fastening element comprises a buttonhole at the bottom of said bag and a matching button belt on said outer packing unit.

2. The vacuum packing device of claim 1, wherein said bag comprising at least a connection edge connecting two sheets that form a body of said bag and said buttonhole is positioned at said connection edge.

3. The vacuum packing device of claim 2, wherein said bag comprises a pointed bottom end, a connection edge and two buttonholes positioned at said connection edge for fastening with said matching button belt from a bottom panel of said outer packing unit.

4. The vacuum packing device of claim 2, wherein said bag comprises a rectangular flat bottom, two connection edges, and at least four buttonholes, two of which are positioned at each of said two connection edges for fastening with said matching button belt from a bottom panel of said outer packing unit.

5. The vacuum packing device of claim 1, wherein said outer packaging part is a square case which comprises a panel on which said button belt is positioned and a cover for enclosing said square case.

6. The vacuum packing device of claim 5, wherein said square case comprises a rectangular rigid base panel, four rigid side panels each having a side connected to said base panel, said side panels forming a continuous side enclosure by connecting to each other with an overlapping side edge fastened with a hook and loop fastener and together with said base panel constituting a cubic case.

7. The vacuum packing device of claim 3, wherein said outer packing unit is made of a flexible material, and a supporting base plate is added to the bottom of said bag and jointly placed in said outer packing unit.

8. The vacuum packing device of claim 7, wherein said supporting base plate comprises two creases dividing it into a bottom part, a left part and a right part so that said left part and right part are each upwardly foldable to become side panels respectively before putting into said packing device.

9. The vacuum packing device of claim 5, wherein said square case comprises a packing belt and an flexible chuck being connected to one end of said packing belt, and said cover comprises a second packing belt and a chuck hole is provided at one end of said second packing belt that allow said flexible chuck to get into the chuck hole and fastened therein.

10. The vacuum packing device of claim 7, wherein said packing belt is equipped packing belt one end of which is provided with a flexible chuck and another end of which is provided with a chuck hole for fastening said flexible chuck.

11. The vacuum packing device of claim 1, wherein said button belt is passing through said buttonhole to realize fastening.

12. The vacuum packing device of claim 11, wherein one end of said button belt is connected to a supporting board and another end of said button belt, after passing through said buttonhole, is connected to said supporting board by use of a button.

13. The vacuum packing device of claim 11, wherein one end of said button belt is connected to a supporting board and another end of said button belt, after passing through said buttonhole, is connected to said supporting board by use of velcro.

* * * * *